US008690515B2

(12) United States Patent
Miller

(10) Patent No.: US 8,690,515 B2
(45) Date of Patent: Apr. 8, 2014

(54) FULLY AUTOMATIC COUPLER FOR EXCAVATOR ARM

(76) Inventor: Gary Miller, Cramlington (GB)

( * ) Notice: Subject to any disclaimer, the term of this patent is extended or adjusted under 35 U.S.C. 154(b) by 53 days.

(21) Appl. No.: 13/420,716

(22) Filed: Mar. 15, 2012

(65) Prior Publication Data

US 2012/0237327 A1 Sep. 20, 2012

Related U.S. Application Data

(63) Continuation of application No. PCT/GB2010/001724, filed on Sep. 13, 2010.

(30) Foreign Application Priority Data

Sep. 17, 2009 (GB) ..... 0916352.8
Feb. 8, 2010 (GB) ..... 1002018.8

(51) Int. Cl.
*B66C 23/00* (2006.01)
*E02F 3/00* (2006.01)

(52) U.S. Cl.
USPC ..... 414/723; 403/322.1; 172/272; 37/468

(58) Field of Classification Search
USPC ..... 414/723; 37/468; 172/272–275; 403/322.1
See application file for complete search history.

(56) References Cited

U.S. PATENT DOCUMENTS 3,935,953 A 2/1976 Stedman
4,488,850 A 12/1984 Wernimont
5,147,173 A * 9/1992 Fauber et al. ..... 414/723
6,422,805 B1 * 7/2002 Miller ..... 414/723
6,481,124 B1 * 11/2002 Miller et al. ..... 37/468
7,493,712 B2 2/2009 McCormick et al.
8,112,914 B2 2/2012 Miller et al.
8,328,459 B2 * 12/2012 Hill ..... 403/322.4
2003/0204972 A1 * 11/2003 Cunningham et al. ..... 37/403
2005/0229445 A1 10/2005 Poquette

FOREIGN PATENT DOCUMENTS

EP 1318242 A2 12/2002
EP 2119834 A2 11/2009
EP 2076631 B1 11/2010

(Continued)

OTHER PUBLICATIONS

International Search Report dated Apr. 3, 2011, in corresponding PCT Patent Application No. PCT/GB2010/001724.

(Continued)

*Primary Examiner* — Scott Lowe
(74) *Attorney, Agent, or Firm* — Brian B. Shaw, Esq.; Thomas B. Ryan; Harter Secrest & Emery LLP

(57) ABSTRACT

A coupler for receiving first and second pins of an accessory. A first latching mechanism is associated with a first jaw, having an arm connected to and extending away from a latching member thereof, and a second latching mechanism is associated with a second jaw, the first and second latching mechanisms adapted to latch the first and second pins of an accessory in or on the first jaw and the second jaw, respectively. The second latching mechanism is powered for movement between a latching position and a non-latching position. The first latching mechanism is connected to, or connectable with, the second latching mechanism to allow operation of the second latching mechanism selectively to operate the first latching mechanism between its own latching and non-latching positions by means of a groove or flange or finger provided on the second latching mechanism.

19 Claims, 12 Drawing Sheets

(56) References Cited

FOREIGN PATENT DOCUMENTS

| | | | |
|---|---|---|---|
| GB | 233570 | A | 4/1999 |
| GB | 2330569 | A | 4/1999 |
| GB | 2332417 | A | 6/1999 |
| GB | 2450127 | A | 12/2008 |
| GB | 2463298 | B | 3/2010 |
| GB | 2467380 | A | 8/2010 |
| WO | 2005026454 | A1 | 3/2005 |
| WO | 2008029112 | A2 | 3/2008 |
| WO | 2008031590 | A2 | 3/2008 |

OTHER PUBLICATIONS

Intellectual Property Office Search Report for GB 1311113.3 dated Jul. 17, 2013 (1 page).

Intellectual Property Office Search Report for GB 1308237.5 dated May 31, 2013 (1 page).

* cited by examiner

FULLY AUTOMATIC COUPLER FOR EXCAVATOR ARM

CROSS-REFERENCE TO RELATED APPLICATIONS

This application is a continuation of International Patent Application No. PCT/GB2010/001724 filed Sep. 13, 2010, and designating the US, the contents of which are expressly incorporated by reference, which claims priority to UK Patent Applications No. GB0916352.8 and GB1002018.8.

STATEMENT REGARDING FEDERALLY SPONSORED RESEARCH OR DEVELOPMENT

None.

REFERENCE TO A "SEQUENCE LISTING"

Not applicable.

BACKGROUND OF THE INVENTION

1. Field of the Invention

The present invention relates to a coupler for attaching an accessory, such an excavator bucket, to an excavator arm of an excavator. In particular, it relates to a fully automatic coupler for attachment, at its top half, to an excavator arm, and having, in its bottom half, two jaws and two latches for selectively securing (or releasing) two attachment pins of an accessory in (or from) the jaws of the coupler.

2. Description of Related Art

Many different couplers for attaching accessories to an excavator arm of an excavator have been developed. Many of those have been either manual or semi-automatic in function, i.e. requiring one or more manual steps to be carried out at the coupler in order to complete or commence the attachment or removal of an accessory onto or from the coupler. An increasing drive, however, is towards providing a fully automatic coupler. Such couplers allow the full securement and release procedure, i.e. for securing or releasing an accessory onto or from the coupler, by the operator from within the cab of the excavator, e.g. via controls provided in the cab.

There is also a further problem with couplers of this type—users occasionally use them incorrectly. Therefore, there is a further drive in the art to provide couplers that either prevent incorrect usage, or which counter incorrect usage by making such usage less dangerous by the provision of secondary or tertiary locking mechanisms, in addition to the primary locking mechanism provided by a latching hook, so as to provide mechanical back up mechanisms for preventing inadvertent release of the accessory from the coupler in the event of an improper use of the coupler.

BRIEF SUMMARY OF THE INVENTION

The present invention therefore seeks to provide a fully automatic coupler having back-up operator control mechanisms incorporated therein.

According to the present invention there is provided a coupler having a top half for attaching to an end of an excavator arm of an excavator and a bottom half for attaching to an accessory, the bottom half comprising:

a first jaw having an opening pointing generally forwards with respect to the coupler for receiving a first accessory attachment member of an accessory; and a second accessory engagement area facing generally downwards with respect to the coupler for receiving a second accessory attachment member;

wherein:

a first latching mechanism is associated with the first jaw, the first latching member having an arm operatively connected to and extending away from a latching member thereof, and a second latching mechanism is associated with the second accessory engagement area, and the first and second latching mechanisms are adapted to latch the first and second accessory attachment members of an accessory in or on the first jaw and the second accessory engagement area, respectively;

the second latching mechanism is powered for movement between a latching position and a non-latching position and the first latching mechanism is operatively connected to, or connectable with, the second latching mechanism to allow operation of the second latching mechanism selectively to operate the first latching mechanism between its own latching and non-latching positions; and the second latching mechanism is provided with a groove or flange or finger for defining a space or surface in or on which a free end of the arm of the first latching mechanism can reside during either or both a coupling and/or a decoupling procedure of the coupler for allowing the movement of the second latching mechanism to operate the first latching mechanism between its latching position and its non-latching position.

Preferably the groove, flange or finger allows the movement of the second latching mechanism to operate the first latching mechanism both from its latching position into its non-latching position and from its non-latching position into its latching position.

Preferably the second latching mechanism is powered by a hydraulic cylinder between its latching position and its non-latching positions. Most preferably the hydraulic cylinder is powerable in either direction—i.e. it is a dual action cylinder for opening the coupler (in an uncoupling procedure), and for closing the coupler (in a coupling procedure).

Preferably the second latching mechanism is associated with a gravity operated blocking bar. The blocking bar is preferably adapted to default, under the influence of gravity, into a blocking position, e.g. behind the second latching mechanism, when the coupler is in a generally horizontal orientation, such as where its front jaw's opening faces horizontally.

Preferably the blocking bar is also adapted to fall under the influence of gravity into a non-blocking position when the coupler is rotated into a crowd position. Such a crowd position can be achieved by manipulation of the excavator, i.e. its hydraulics and its excavator arm, from within the cab of the excavator.

A separate actuator, however, might instead be provided for the blocking bar.

Preferably the first latching mechanism has a latching face adapted at least partially to close the first jaw of the coupler when the first latching mechanism is in a latching state.

Preferably, as the second latching mechanism is powered into a non-latching position, the free end of the arm of the first latching mechanism, upon engagement by the second latching mechanism, is lifted by the movement of the second latching mechanism, so as to lift, for example, the latching face of the first latching mechanism out of the mouth of the first jaw, i.e. into a non-latching position.

Preferably a flange or finger is provided at the rear of the second latching mechanism, that flange or finger being arranged so as to engage the free end of that arm as defined above. With this arrangement, as the second latching mechanism is powered into a latching position, the arm is engaged by that flange or finger so as to drive the first latching mechanism back into its latching position.

A spring may be provided selectively to bias the blocking bar into a blocking position. Preferably that spring is attached to the blocking bar and it has a free end that selectively bears, in use, against the excavator arm of the excavator such that it can act selectively, e.g. while the coupler, with respect to the excavator arm, is in a fully open or extended condition, i.e. at an opposite extreme of rotation relative to the excavator arm as compared to the crowd position, but not when the coupler is in a crowd position relative to the excavator arm. As a result, the blocking bar can be disengaged from the second latching mechanism when the coupler is both inverted and in the crowd position—the latter allows the spring to disengage from operation, but not when the coupler is inverted while in a fully extended condition with respect to the excavator arm. This in turn means that a disengagement of an accessory should only be possible while the coupler is both inverted and in a crowd position with respect to the excavator arm.

In an alternative embodiment, the blocking bar may be arranged such that it is always biased towards a blocking position. For example, this may be achieved with a spring that permanently acts against the blocking bar. That spring may be a conventional coil spring attached between the frame of the coupler and the blocking bar, or extending between the frame, or some other part of the coupler (e.g. the rear latching mechanism or hook), and the blocking bar. For example, it may be coiled around the pivot pin for the rear hook, with free arms thereof extending one down the back of the hook and the other towards the blocking bar for engaging near a free end thereof. Preferably, however, it is a spring that is concealed within the blocking bar so as to be protected from dirt ingress—a dirty spring can more readily fail than a clean spring (e.g. as a result of the coils not being able to spring together due to dirt between the coils). Alternatively it might be integral with the blocking bar. Where the blocking bar is permanently biased towards a blocking position, it is preferred that a counter-biasing means is provided for selectively biasing the blocking bar against the permanent bias towards a non-blocking position. Thus, upon activation of the counter-biasing means (e.g. a second actuator, such as a hydraulic ram), the blocking bar can be remotely lifted into a non blocking position. Such a counter-biasing means is especially needed where the spring bias is such that upon inverting the coupler, the blocking bar's own weight is insufficient to overcome the force of that bias. With this arrangement, the blocking bar can be lifted without inverting the coupler, which allows the coupler to be used for switching accessories on the excavator even in environments where the crowd position cannot be achieved (such as in areas with a low ceiling—e.g. in tunnels; the arm of the excavator need to point it's elbow generally upwards when the crowd position for the accessory is being achieved).

Preferably the counter biasing means is operated via a separate switch to the actuator provided for powering the second latching mechanism.

The spring for biasing the blocking bar into its blocking position, as mentioned above, is preferably a concealed spring. For example, it can be a spring (e.g. a coil spring) mounted within a chamber in or along the shaft of the blocking bar. Preferably, however, that spring is arranged non-coaxially with respect to the central axis of the shaft of the blocking bar, or such that its axis is not incidental with the pivot axis of the blocking bar, whereby the spring can provide a rotation moment for the blocking bar for biasing it towards the blocking position. In the preferred arrangement, the spring extends parallel to the axis of the shaft of the blocking bar, and it has one end attached to the shaft of the blocking bar, e.g. at a blind-end of a chamber of the shaft, and a second end that is attached to an element of the coupler that has a part that is fixed relative to the frame. That fixed part is preferably located lower down in the coupler than the pivot axis of the blocking bar. As such the spring can be a spring in tension. However, mounting that fixed point above that pivot axis allows the spring instead to be a compressed spring, assuming that the blocking bar needs to drop down into a blocking position. Irrespective of the geometry, however, the rotation moment provided by the biasing means needs to be such as to cause the blocking bar to be biased towards its blocking position.

Regarding the counter-biasing means, that is preferably a hydraulic ram, and it preferably has a separate hydraulic feed to the coupler's primary actuator (the actuator for powering the second latching mechanism). This allows the two actuators to be controlled independently of one another. This is important for preventing inadvertant release of the blocking bar. A common hydraulic return, however, can be provided.

Preferably the two actuators are operated by separate switches in the cab of the excavator, each switch operating a separate solenoid for controlling two separate feed-pipes, one heading to the primary actuator and the other heading to the actuator that acts against the blocking bar.

In one arrangement, the actuator/hydraulic ram/counter biasing means for the blocking bar extends coaxially to the blocking bar's biasing means. For example, the spring and the actuator may be concentrically arranged relative to one another, or they may be arranged as a sprung actuator, i.e. a hydraulic ram with an integrated spring for causing that ram to assume a non-extended condition (or an extended position where the spring needs to extend to move the blocking bar into a blocking position) when it is not being powered. Alternatively, the spring and actuator are arranged separately. For example, the spring or ram may be arranged within the blocking bar, whereas the other element (the actuator or the spring, correspondingly) is arranged in a conventional manner, i.e. externally of the blocking bar. The actuator nevertheless still is arranged to act upon the blocking bar to move, lift or raise it between a blocking and a non-blocking position, with the spring, or the like tending to bias it back into a blocking position.

By arranging the blocking bar's piston or spring, or both, substantially parallel to, but spaced away from, the longitudinal axis of the blocking bar, a less cluttered coupler can be provided, whereby it can be made smaller. Further, where the spring is internal, dirt can less easily affect the operation of that spring or piston, whereby the coupler requires less frequent cleaning or servicing for removal of such dirt.

With this alternative blocking bar arrangement, an accessory can be disengaged from the coupler either while inverted or non-inverted, purely by the operation of that piston. As discussed, however, that piston, preferably operates via a separate hydraulic feed to the main hydraulic cylinder or actuator of the coupler, i.e. the actuator for operating the rear hook/latching means.

In a further development of this, the actuator for the blocking bar can be fitted with a tilt detection circuit for preventing operation thereof when the coupler is not inverted. Likewise, a separate blocking bar for the blocking bar can be provided to prevent a movement of the blocking bar into a non blocking position other than when a rotation of the coupler is provided in an "into the crowd position" direction. Time delays on the actuator for the blocking bar might also be integrated into the system, whereby only upon holding a control switch in a decoupling position for a long enough period of time will a decoupling procedure commence. This prevents accidental one-touch decouplings.

Alternatively, or additionally, the arm of the first latching mechanism can act as a blocking bar, by way of its free end being arranged relative to the rear of the second latching mechanism such that it would bear against a non-arm-lifting part of the second latching mechanism for preventing release of the accessory prior to an inversion of the coupler. It might even be provided with a lift mechanism or a biasing means such as that described above for the blocking bar. Preferably, however, the powered blocking bar arrangement is instead provided, and the coupler is arranged or designed so as not to require an inversion prior to release of an accessory. As such, the free end of the arm is preferably arranged instead to engage with the groove, flange or finger of the second latching mechanism in a non-blocking manner relative to the second latching mechanism, i.e. such that a powering back of the second latching mechanism from a latching position into a non-latching position will always cause the first latching mechanism to be lifted into a non latching position. For that purpose, the rear of the second latching mechanism can be suitably profiled to provide an arm-lifting surface, e.g. by the provision of a ramp on its back, or some other suitably angled surface for engagement with the free end of the arm as the second latching mechanism is powered into an open configuration. The arm can even be made to flex upwardly into an arch, e.g. by being made of an elastic material, such as spring steel, or a set of spring steel plates, as it gets engaged by the end facing surface of the second latching mechanism. Such an arching of the arm can then rotate the latching part of the first latching mechanism for lifting that latching part of the first latching mechanism into an open (non-latching) position.

Preferably the second accessory engagement area is a second jaw having an opening pointing generally downwards with respect to the coupler.

Preferably the first accessory attachment member on an accessory is an accessory pin mounted onto the accessory.

Preferably the second accessory attachment member of the accessory is an accessory pin mounted onto the accessory.

Preferably both accessory attachment members are accessory pins mounted onto the accessory.

Preferably the first latching mechanism comprises of a rocker latch for partially closing the first jaw when in a "dropped" or jaw closing position.

Preferably the arm extends from the rocker latch or a latching plate thereof.

Preferably the arm of the first latching mechanism extends within the coupler inside the framework or frame of the coupler.

Preferably the arm extends towards the second latching mechanism. Usually this results in it extending away from the first jaw.

Preferably the arm is formed of an elastic material, such as spring steel, or a set of spring steel plates. The arm can then flex, thus allowing an accessory pin to be inserted into the first jaw without first opening the second jaw by forcing the accessory pin into the first jaw. The first latching mechanism can have a tapered front face for facilitating this. The elasticity in the material also prevents the arm from breaking, or deforming non-elastically, i.e. plastically, if the second latching mechanism is powered into a latching position while the first latching mechanism is not able to assume its own latching mechanism due to, for example, a blockage, e.g. if the attachment pin within the first jaw is not fully seated within that jaw, thereby lying in the path of the first latching mechanism. Movement of the second latching mechanism into its latching position, however, will force the accessory rearwardly relative to the coupler, by way of its interaction with the other attachment pin, thereby moving that first attachment pin properly into the back of the first jaw. The first latching mechanism would thus assume its latching position, due to the bias provided by its arm against the groove, flange or finger of the second latching mechanism, once the accessory has moved sufficiently rearwardly to remove the blockage caused by that attachment pin within the first jaw.

Preferably the first latching mechanism is painted in a high visibility colour, such as red or yellow or orange.

Preferably the first latching mechanism is pivotally mounted relative to the frame of the coupler. Preferably it is mounted to the frame on a pivot pin.

Preferably the second latching mechanism is pivotally mounted relative to the frame of the coupler. Preferably it is mounted to the frame on a pivot pin.

Preferably the second latching mechanism consists of a hook member.

Preferably the flange, finger or groove extends from or into a rear surface of the second latching mechanism.

Preferably a rear surface of the second latching mechanism is stepped in an area thereof, each step defining a location against which a free end of a blocking bar may bear to allow multiple different blocking positions for the blocking bar. This permits the coupler to be used safely on a variety of different accessories, each having different accessory pin centres (distances between the pin centres).

Preferably the rear of the second latching mechanism is bifurcated with one side of the fork providing a location for the flange, finger or groove.

Preferably the second side of the fork defines one or more surface against which a free end of a blocking bar may bear. That a plurality of surfaces may be provided by means of steps.

The present invention also resides in the design of the second latching mechanism. According to the present invention, therefore, there is also provided a pivoting latching hook, for example for latching against an attachment pin of an accessory, the hook comprising:

a pivot axle about which, in use, it pivots relative to a frame; and an actuator axle about which, in use, it pivots relative to an actuator;

wherein the rear of the hook is bifurcated, one fork comprising a stepped surface and the second fork comprising a flange, a finger or a groove, and a shoulder, the shoulder and the flange, finger or groove defining two generally opposed bearing surfaces.

The present invention also provides a coupler for coupling an accessory to an excavator arm of an excavator comprising such a latching hook.

The hook can comprise any of the other features shown in the drawings, or as discussed above or below.

The present invention also resides in the design of the powered blocking bar. According to the present invention, therefore, there is also provided a coupler for coupling an accessory to an excavator arm of an excavator, the coupler comprising a latching mechanism for latching against an attachment pin of the accessory, and a blocking bar, for selectively resisting movement of the latching mechanism, wherein the blocking bar has an integrated spring or piston, or both, the integrated spring or piston being mounted within a chamber within the blocking bar. Preferably the chamber extends substantially parallel to, but spaced from, the central axis of the blocking bar lying coincident with the bar's pivot axis. It might also extend in other directions, with the spring then arranged suitably. For example, the spring may extend perpendicular to the axis of the blocking bar, or vertical relative to the coupler (when the coupler is in a horizontal orientation).

The blocking bar, or the coupler, may have other features as described above, or below, or as shown in the drawings.

The present invention also resides in the design of the first latching mechanism. According to the present invention, therefore, there is also provided a coupler for coupling an accessory to an excavator arm of an excavator, the coupler comprising a jaw associated with a latching mechanism for latching an attachment pin of the accessory within the jaw, the latching mechanism comprising a jaw closing member that is pivotally mounted relative to the jaw, that jaw closing member at least partially closing the jaw when positioned in a jaw closing position, and having extending therefrom, within the framework of the coupler, an arm, the arm being resiliently flexible along at least a part of its length such that it flexes when a sufficient force is applied at or near its free end.

Preferably the arm is formed from spring steel. More preferably it is formed from a series of spring steel plates.

The arm can be bolted onto the jaw closing member.

Preferably the jaw is a front jaw of the coupler.

Preferably the coupler comprises a second latching mechanism for securing against a second pin of the accessory. Preferably that second latching mechanism is a rear hook of the coupler.

Preferably the second latching mechanism is pivotally mounted relative to a frame of the coupler.

Preferably the second latching mechanism is associated with a second jaw of the coupler.

Preferably the arm extends between the first latching mechanism and the second latching mechanism so as to be engageable at or near its free end by the second latching mechanism. Preferably the second latching mechanism has a groove, flange or finger for selectively engaging the arm at or near the arm's free end.

This coupler may further comprise other features as described above, or below, or as shown in the drawings.

The present invention also provides a coupler comprising first and second jaws for receiving first and second accessory pins of an accessory, wherein: a first latching mechanism is associated with the first jaw, the first latching member having an arm operatively connected to and extending away from a latching member thereof; a second latching mechanism is associated with the second accessory engagement area; the first and second latching mechanisms are adapted to latch the first and second accessory attachment members of an accessory in or on the first jaw and the second accessory engagement area, respectively; the second latching mechanism is powered for movement between a latching position and a non-latching position; and the first latching mechanism is operatively connected to, or connectable with, the second latching mechanism to allow operation of the second latching mechanism selectively to operate the first latching mechanism between its own latching and non-latching positions by means of a groove or flange or finger provided on the second latching mechanism.

This coupler may further comprise other features as described above, or below, or as shown in the drawings.

BRIEF DESCRIPTION OF THE SEVERAL VIEWS OF THE DRAWING(S)

These and other features of the present invention will now be described, purely by way of example, with reference to the accompanying drawings in which:

FIG. 1 schematically shows a breakaway perspective view of the internal working mechanisms of a coupler in accordance with the present invention;

Figure 6:
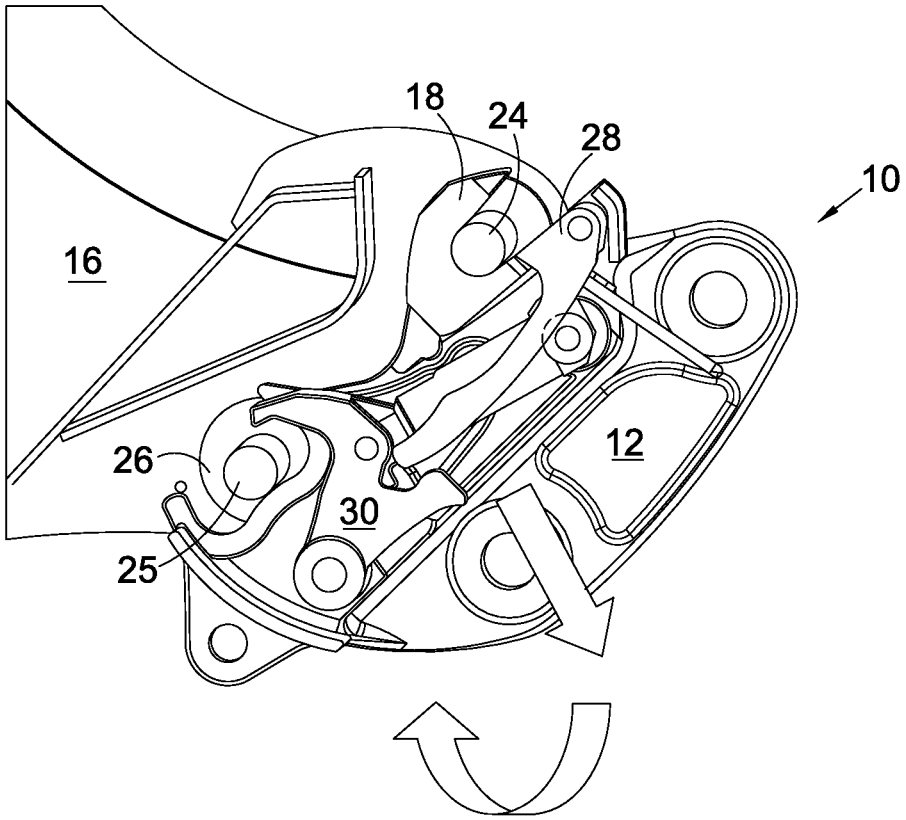
Figure 7:
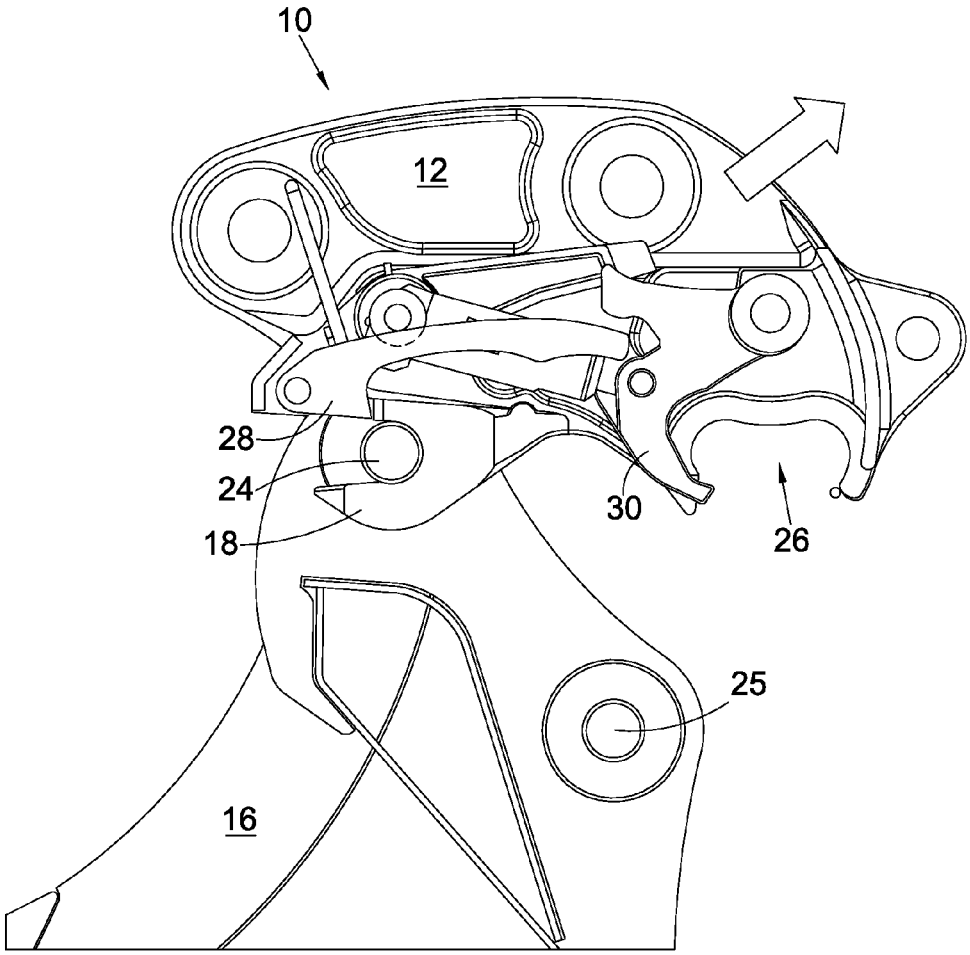
Figure 8:
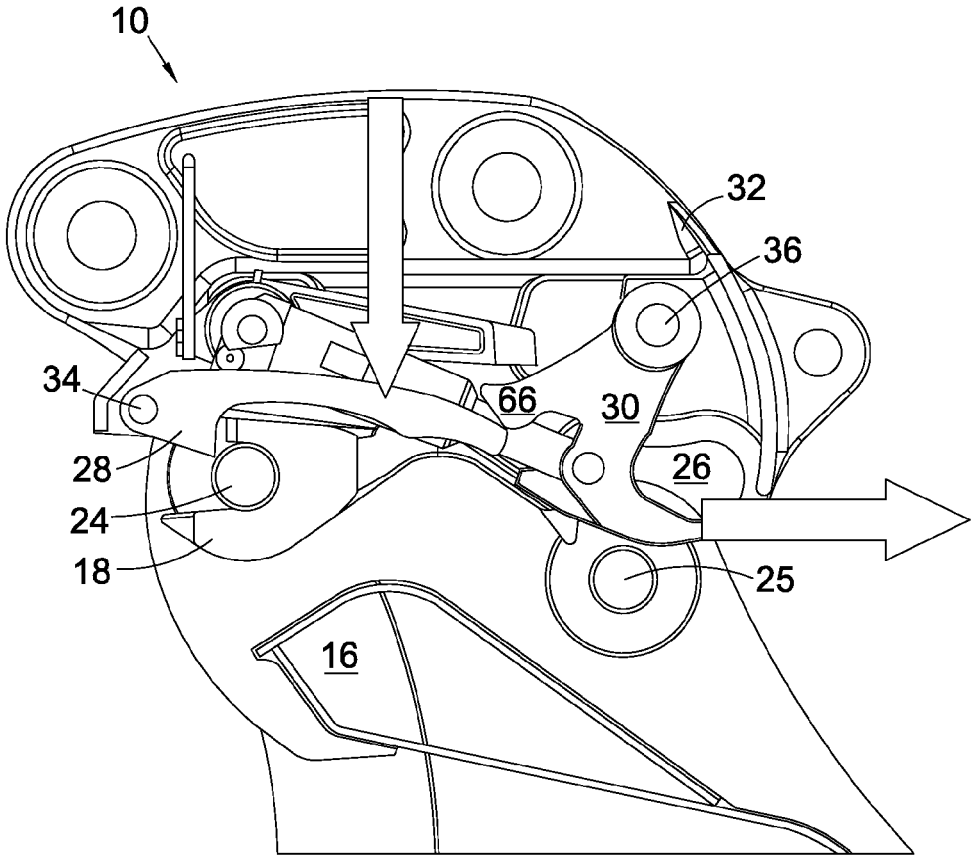
Figure 9:
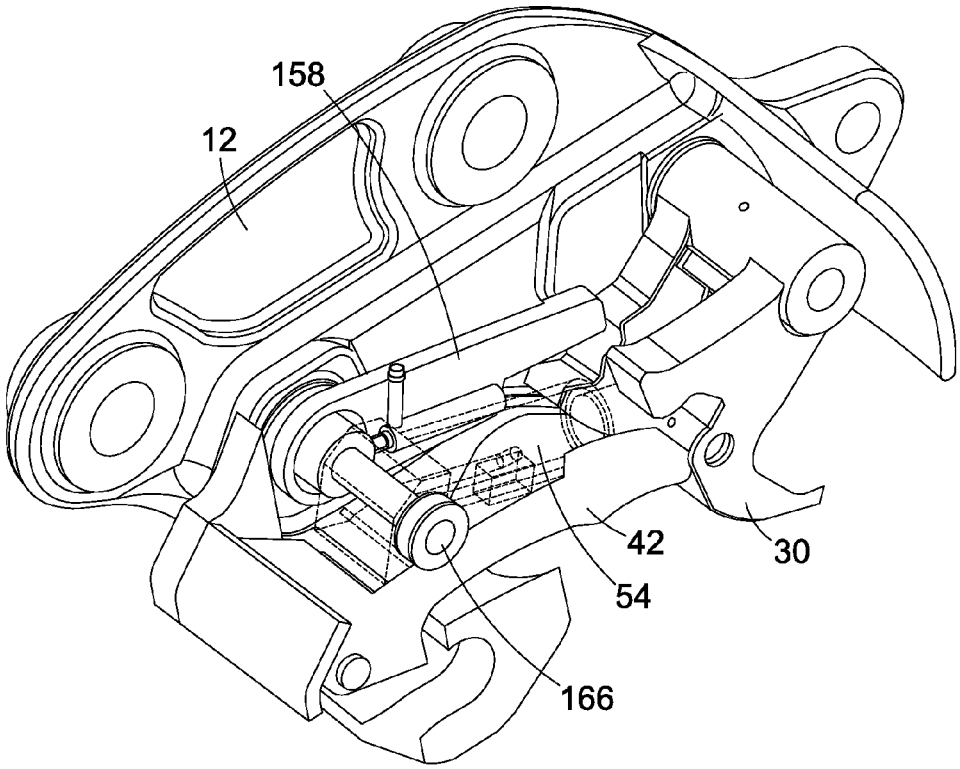
Figure 10:
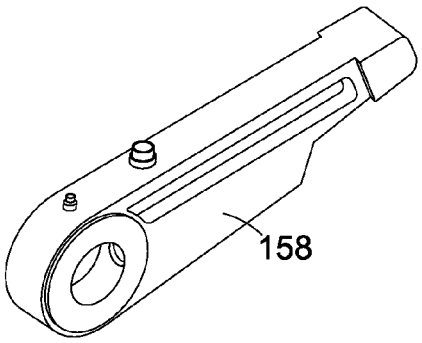
Figure 11:
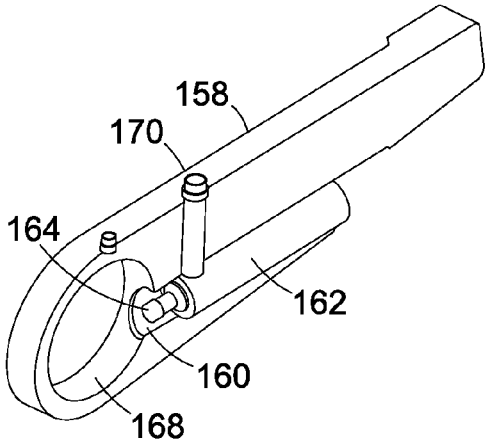
Figure 12:
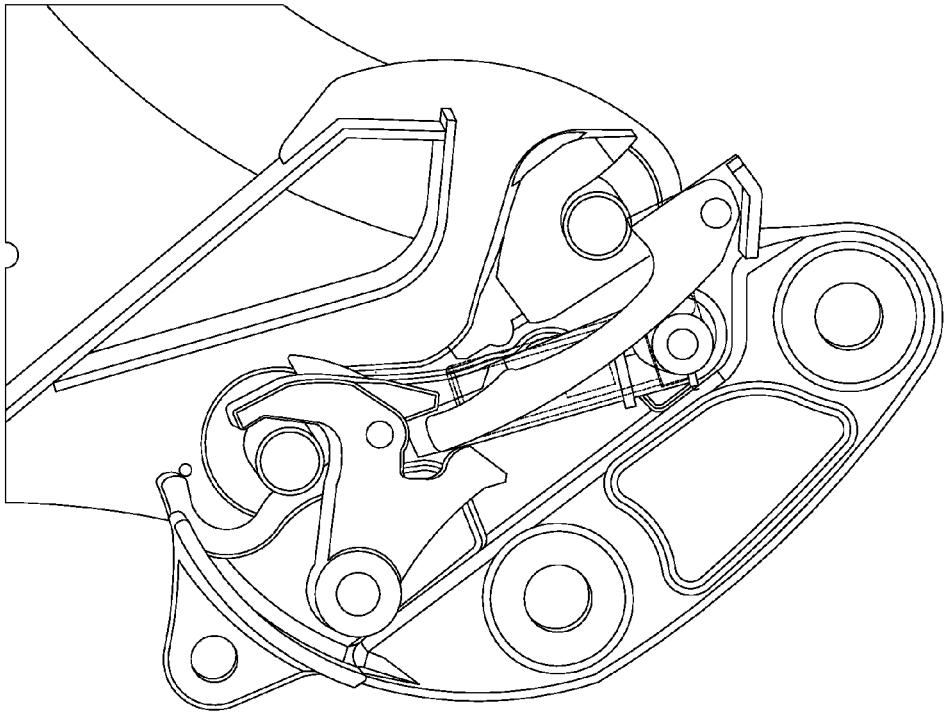
Figure 13:
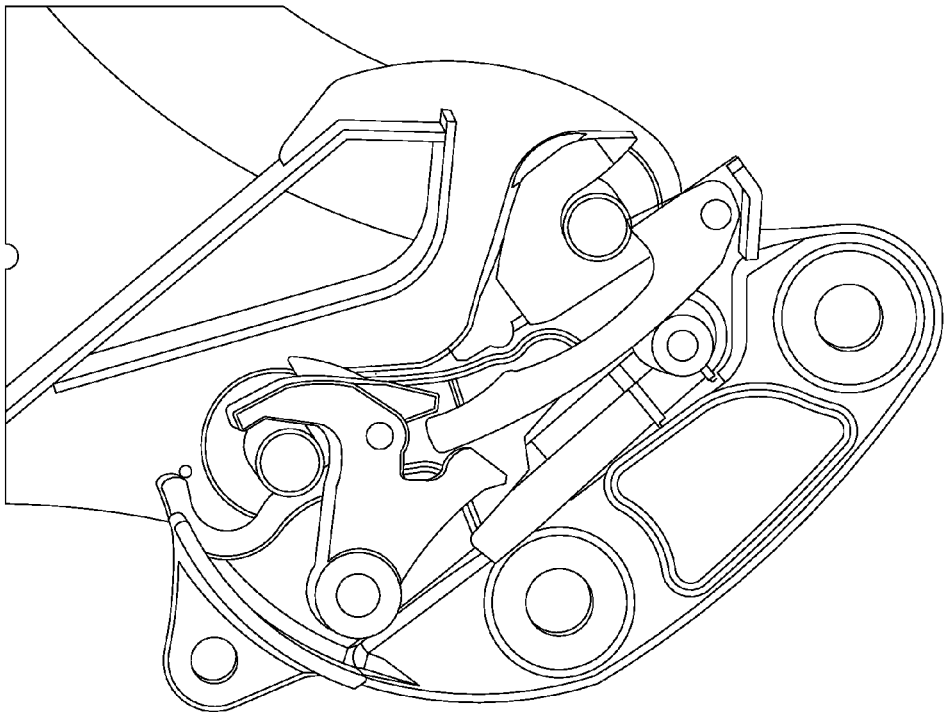
Figure 14:
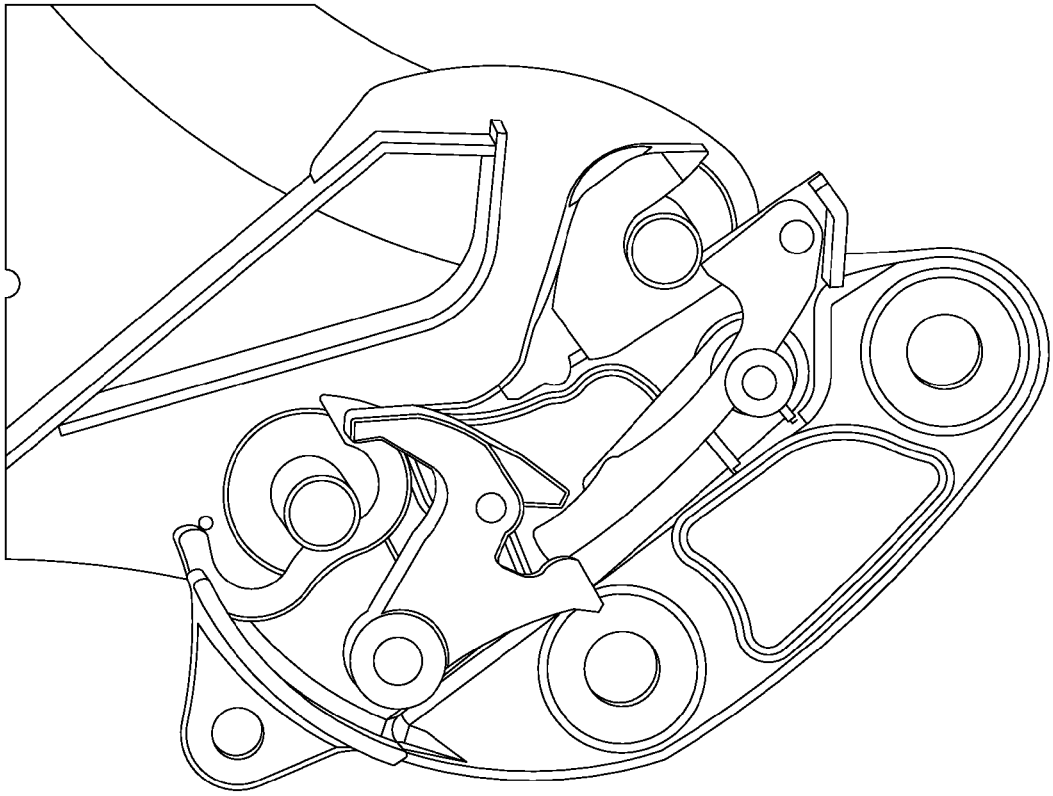
Figure 15:
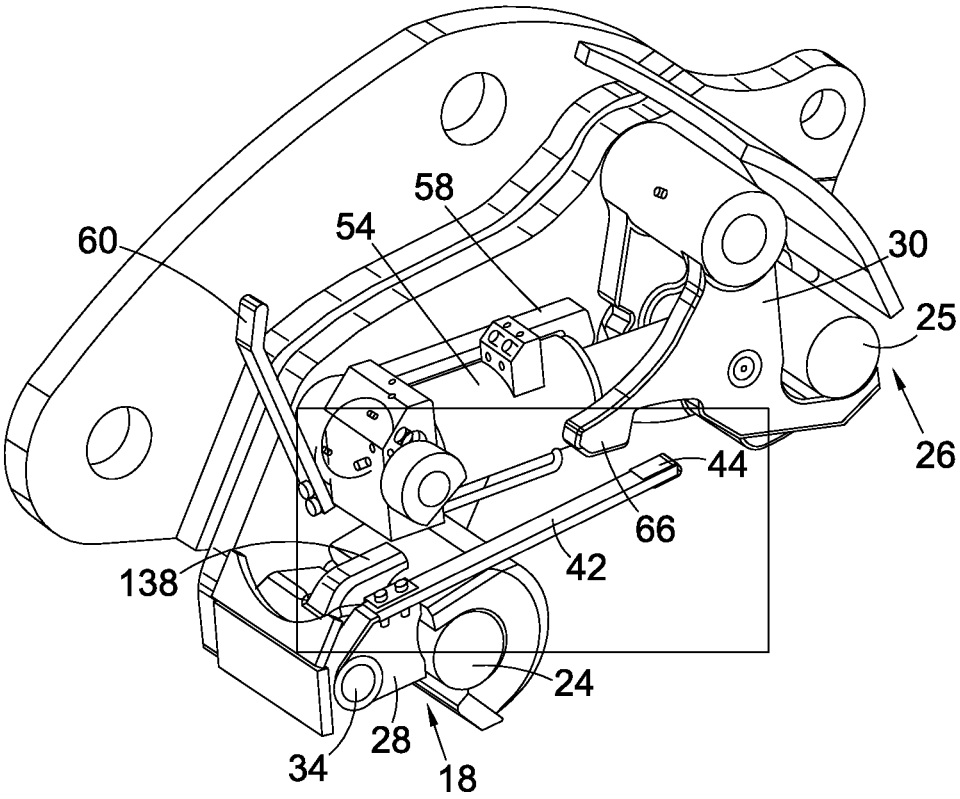
Figure 16:
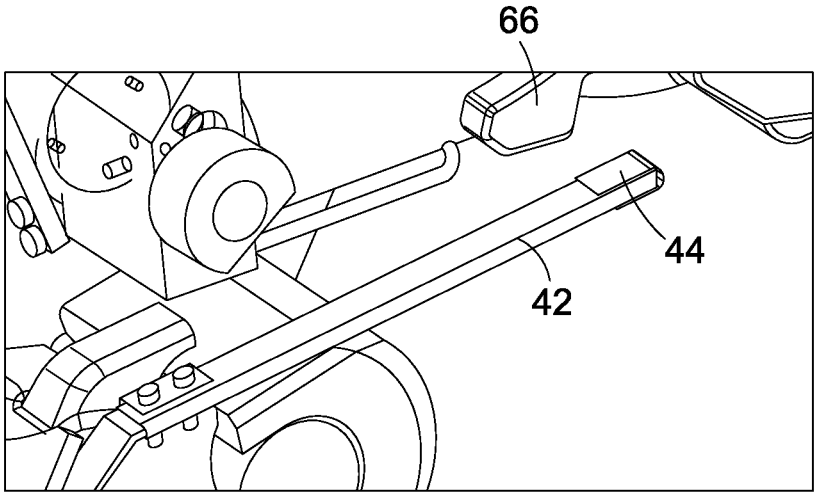

FIG. 6 shows step 1 of an accessory removal procedure, in which the coupler has been moved into a crowd position for disengaging the blocking bar, by means of which the second latching mechanism can be retracted by the hydraulic cylinder to open both of the jaws (the weight of the bucket retains the bucket's first accessory pin within the front jaw of the coupler whereby the bucket cannot fall off the coupler);

FIG. 7 shows step 2 in the accessory removal procedure, in which the bucket has been placed on the ground by lowering and uncrowding the coupler, and in which and the coupler has then been moved away from the bucket;

FIG. 8 further illustrates the safety mechanisms of the present invention for preventing an inadvertent decoupling of an accessory even upon an incorrect or missed engagement of the second accessory pin during the attachment process;

FIG. 9 shows a coupler in accordance with a second embodiment of the present invention with a cutaway view within the blocking bar thereof and with the actuator thereof shown in phantom;

FIGS. 10 and 11 provide further views of the blocking bar of this second embodiment;

FIGS. 12 to 14 show steps involved in a disengagement of an accessory from the coupler of this second embodiment with the coupler in an inverted orientation; and FIGS. 15 and 16 show a further embodiment, in which the arm of the first latching mechanism is elastic.

DETAILED DESCRIPTION OF THE INVENTION

Figure 1:
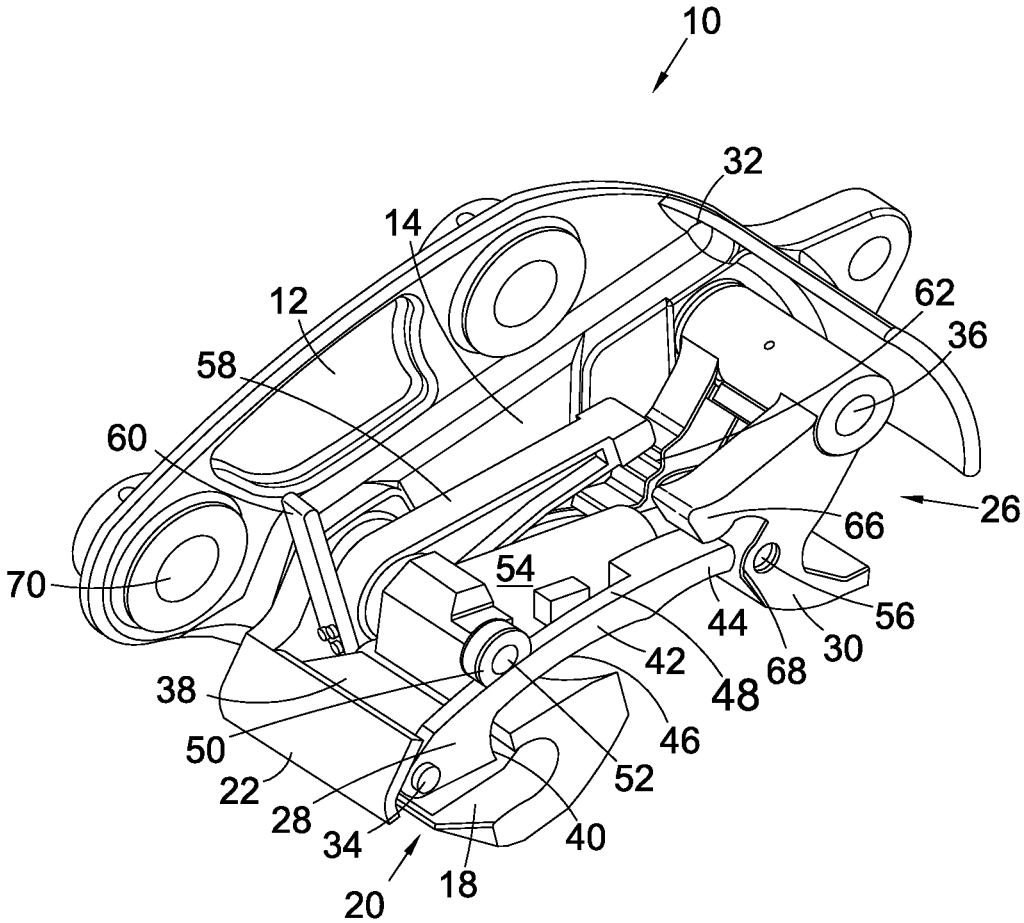

Referring first of all to FIG. 1, there is shown a coupler 10 having a first half 12 for mounting onto an end of an excavator arm of an excavator (not shown) and a bottom half 14 in which is mounted the working mechanisms of the coupler 10. In this illustrated embodiment, the top half 12 of the coupler 10 is mounted onto the excavator arm of the excavator by a pair of accessory pins (not shown), as is conventional for excavator couplers and accessories. Other known mechanisms for mounting couplers to an excavator arm can also be used instead, by making appropriate changes to the top half of the coupler.

The bottom half 14 of the coupler accommodates the working mechanism of the coupler 10. It consists of a first jaw 18 having an opening 20 at or near the front 22 of the coupler 10. That opening faces the forwards direction relative to the coupler. The first jaw 18 is for receiving a first accessory pin or accessory attachment member of an accessory, such as an excavator bucket.

Towards the rear of the coupler, there is provided a second jaw, or a second accessory engagement area 26. That second jaw 26 has an opening that faces downwards relative to the coupler 10 and is for receiving a second accessory pin or accessory attachment member 25.

The first jaw 18 is associated with a first latching mechanism 28, whereas the second jaw 26 is associated with a second latching mechanism 30. The first and second latching mechanisms 28, 30 are shown to be hingedly mounted onto the frame 32 of the coupler 10 by hinge pins 34, 36. Those hinge pins 34, 36 extend transversely through the bottom half of the coupler. It should be appreciated, however, that in alternative embodiments, the hinge pins might extend through the frame of the coupler in the top half 12 of the coupler 10, dependent on the specific configuration of the relative jaws 18, 26, the latching mechanisms 28, 30 and the frame 32 of the coupler 10.

The first latching mechanism 28 comprises toggle latch having a latching plate 38 through which the hinge pin 34 passes. That latching plate 38 has a latching surface 40 that surface faces generally rearwardly relative to the coupler. In its latching position, that latching surface extends at least part way across the opening 20 of the first jaw 18 so as to close the first jaw 18. However, when the latching mechanism is lifted into a non latching position, that latching plate 38, and the latching surface 40 thereof, become retracted into a top wall of the first jaw 18 so as to open the opening 20 of the first jaw.

Integrally formed with that latching plate 38 is an arm 42. That arm 42 has a free end 44 that can be made thicker than the rest of the arm 42 so as to give it a heavy end. That heavy end moves the latch's centre of gravity whereby the arm 42, and the latching plate 38, readily move about their hinge pin 34 under the influence of gravity. As such, that latching mechanism will tend to move towards a closed or latching position whenever the coupler is in a normal, substantially horizontal, orientation. Likewise it will tend towards an unlatching position when the coupler is inverted. This arrangement helps with the smooth operation of the working mechanism of the coupler. It should be observed, however, that the engagement of the free end of the arm with the second latching mechanism restricts the free movement of the arm and the first latching mechanism, as discussed below.

Referring again to FIG. 1, the underside 46 of the arm 42 is cut out. This serves to cause the latching surface to extend out of the plane of the arm. Further, that underside 46 of the arm 42 is adapted to restrict the downward motion of the arm 42 relative to the frame of the coupler—it will fall down into engagement with an inside face of the frame (or an inner surface of the body or of the jaw 18).

The upper side 48 of the arm also defines a motion limiting surface for the arm since in its uppermost position that upper side 48 engages against a bearing 50 for a hinge pin 52 of the coupler's primary actuator. In some embodiments, the upper side 48 of the arm 42 might have a cut-away portion in it to allow a greater range of movement for the arm 42. However, in the illustrated embodiment, such a cut out is replaced by giving the bearing 50 a cut-away surface instead, whereupon that bearing is non-circular. In other embodiments, both cut-outs might be desirable, on no cut outs might be needed, all dependent upon the configuration of the various moving elements, and the range of motions required.

As discussed above, the primary actuator 54 of the coupler 10 is mounted on a hinge pin 52. That hinge pin, in this embodiment, extends parallel to the two previously described hinge pins 34, 36. As such it is likewise mounted to the frame 32 of the coupler 10. A pivotal mounting of the actuator relative to the frame of the coupler is to allow the actuator 54 to pivot relative to the frame 32 as it operates the working mechanism of the coupler 10.

In this illustrated embodiment, that actuator 54 is a hydraulic cylinder with a dual acting piston for both driving and retracting the second latching mechanism 30 between its latching position and its unlatching position. Such hydraulic cylinders are well known in the art. They have one end pivotally attached to the frame by a hinge pin, as discussed above, and a second end pivotally mounted onto a second hinge pin 56, this time located on the second latching mechanism 30. As a result, the latching mechanism 30 is operatively connected to the actuator 54 for movement relative to the frame.

Instead of an hydraulic actuator, other forms of actuator can be provided, such as screw thread actuators, or hydraulic motors.

In this embodiment, a blocking bar 58 is also mounted onto the hinge pin 52 for the actuator 54. That blocking bar is adapted to be selectively biased into a blocking position by a spring 60. The operation of this type of blocking bar 58 is described, for example, in GB 2330570. However, in the present invention, that blocking bar does not just serve to restrict movement of the second latching mechanism; it additionally restricts movement of the first latching member! That is by means of the inter-relationship between the first and second latching mechanisms, as discussed below. Nevertheless, it has many similar features to the prior art blocking bars. For example, the rear of the second latching mechanism has, at least at the part that aligns with the blocking bar 58, a stepped surface 62. This allows the blocking bar 58 to block the second latching mechanism 30 in a selection of different positions relative to the frame. As a result, the blocking bar can provide a blocking function for the second latching mechanism for a number of different buckets or accessories 16, each having different accessory pin centres (i.e. different pin centre to pin centre spacings), as occurs between different accessory manufacturers.

It will be appreciate, however, that an alternative construction might place the stepped surface onto the end of the blocking bar, rather than on the second latching mechanism.

Referring next to the second latching mechanism, it basically consists of a pivoting latching hook mounted for pivotal movement relative to the frame 32 of the coupler 10 on the hinge pin 36, and driven by the actuator 54, all as described above. Many of its features, in that regard, are similar to prior art arrangements. However, the rear of that latching mechanism has been changed so as to be bifurcated such that one half has the stepped surface 62 for interaction with the blocking bar, whereas the second half has a rearwardly extending flange of finger 66 for restricting or causing movements of the arm 42 of the first latching mechanism 28. This is achieved since the free end of that arm can engage thereagainst, for example as the second latching mechanism 30 is moved from an open position into a latching position.

The rear of the second latching mechanism 30 also has a knuckle 68 that faces that flange or finger 66, thereby providing two generally opposed bearing surfaces—one for opening the first latching mechanism and one for closing the first latching mechanism, as discussed below.

Between the knuckle and the flange or finger, there is defined a groove into which the free end of the arm may extend, such as during the movement of the second latching mechanism. That knuckle 68 therefore provides a bearing surface that serves to engage the free end 44 of the arm 42 of the first latching mechanism for causing that arm to lift as the second latching mechanism is retracted by the actuator. This in turn means that both the front and rear jaws of the coupler are opened substantially simultaneously 18.

It will therefore be appreciated that the flange (or finger) 66 and the knuckle 68 serve together to cooperate with the free end 44 of the arm 42 for opening and closing the front jaw as the second latching mechanism (i.e. the rear hook 30) moves.

Figure 5:
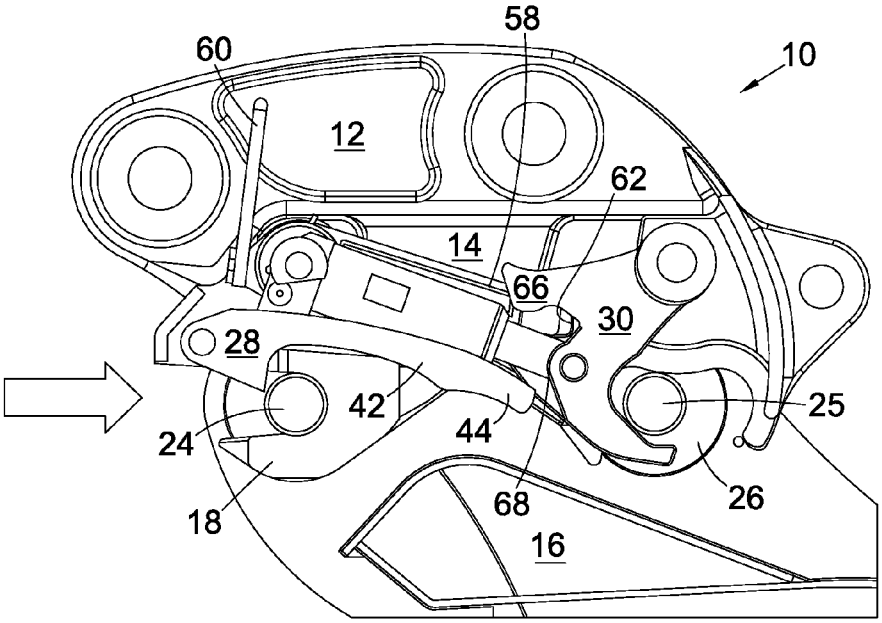
FIG. 5 shows the same coupler, now with the two accessory pins safely secured within the jaws of the coupler—the blocking bar has been engaged behind the rear of the second latching mechanism, and the front latching mechanism is resting in a latching condition for the front jaw.

Referring now to FIG. 5, however, which shows the fully engaged coupler on a bucket, that interaction between the shoulder 68 and the free end of the arm 42 is not by default achievable—the retraction of the hook 30 is blocked initially by the blocking bar, and failing that it is also blocked by the location of the free end 44 of the arm 42—below the knuckle 68. Therefore that interaction between the knuckle and the free end 44 of the arm 42 is only achievable when both 1) the blocking bar 58 is not preventing retraction of that hook 30 by its free end engaging the stepped surfaces 62 of the hook 30 and 2) the arm 42 has been "lifted" away from its default rest position. These two actions both occur only when the coupler is inverted into a crowd position—see FIGS. 2 and 6, as explained below.

Figure 2:
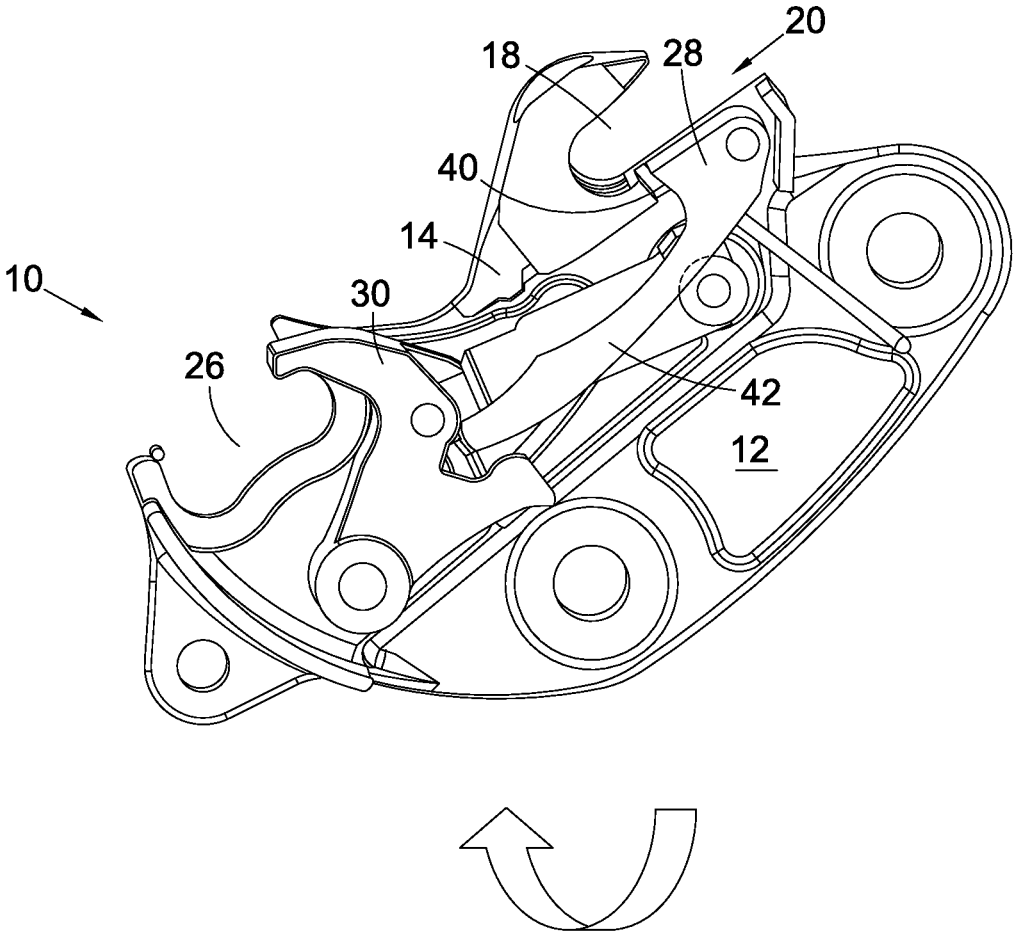
FIG. 2 shows a schematic cutaway side elevation of the coupler of FIG. 1 rotated into a crowd position, with its first and second latching mechanisms fully retracted.
Figure 3:
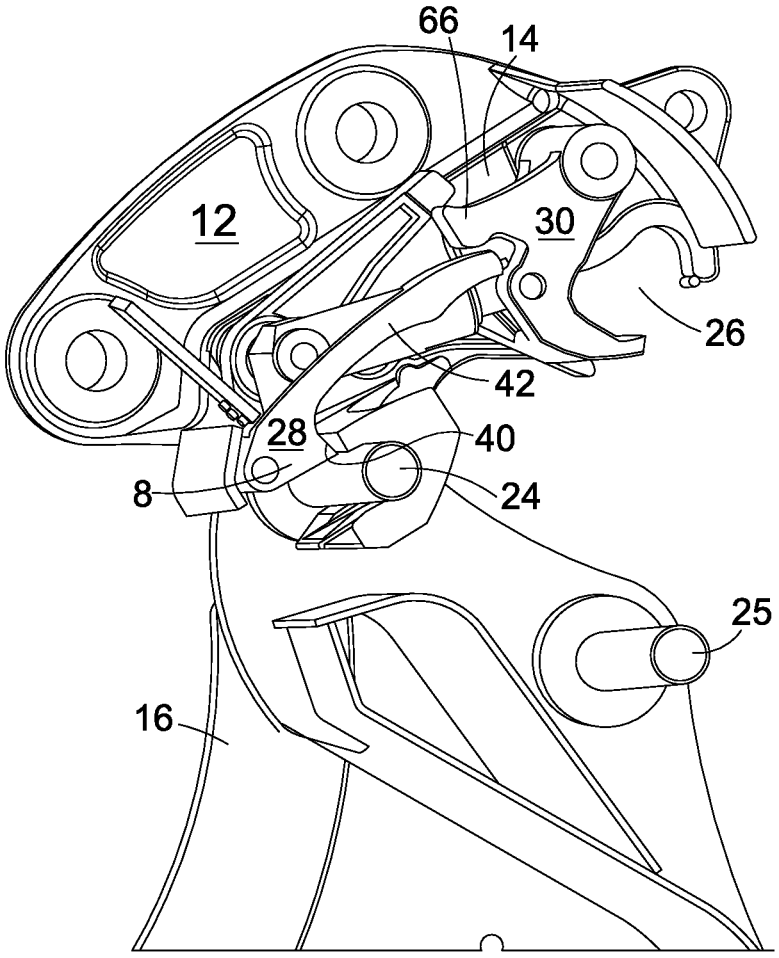
FIG. 3 shows the coupler of FIG. 2, but reoriented and engaged upon a first accessory pin of an accessory, such as an excavator bucket.
Figure 4:
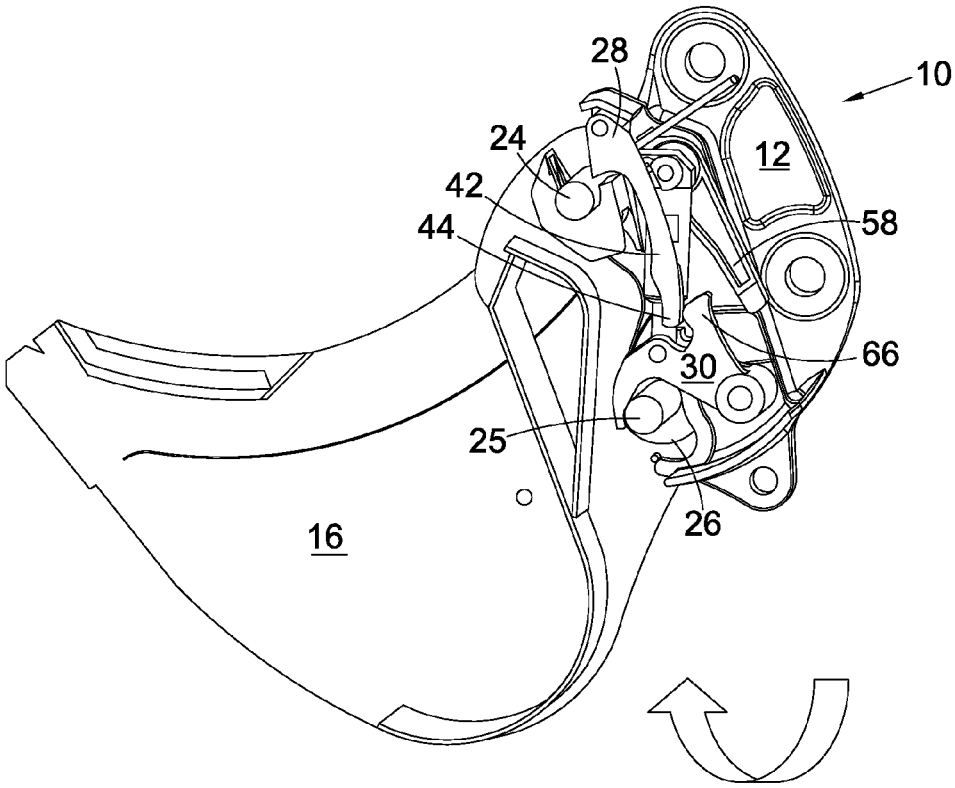
FIG. 4 shows the same coupler again, but now rotated relative to that bucket to engage the second accessory pin in the rear jaw of the coupler, and having had the second latching mechanism driven into a latching position.

The operation of the coupler 10 of the present invention will now be discussed with reference to the two sequences of Figures: FIGS. 2, 3 and 4, and then FIGS. 5, 6 and 7.

FIGS. 2 to 4 illustrate an accessory connecting procedure. Referring first of all to FIG. 2, the coupler 10 is manipulated by the excavator's excavator arm and hydraulics into a fully crowded position, or the crowd position. This position allows both the blocking bar 58 to disengage from the stepped surfaces 62 of the second latching mechanism 30, and the free end 44 of the arm 42 to "lift" above the shoulder, both due to gravity. It should be observed that this crowd position does not engage the spring 60 against the arm of the excavator—that spring 60 only engages against the arm of the excavator when the coupler is oppositely rotated, i.e. towards a fully extended position with respect to the excavator arm.

Once inverted into the crowd position, the second latching mechanism 30 can be retracted using the actuator 54 (it is no longer blocked from such movement by either the arm 42 or the blocking bar 58). As that second latching mechanism is retracted into its open position, its shoulder will engage against the underside of the free end of the arm (if the arm fails to free-swing under the influence of gravity) to thereby not just open the second jaw 26, but also the first jaw 18. The coupler's jaws will therefore both fully open.

In preferred embodiments, a control mechanism can sense this position (e.g. via sensors in the hydraulics, or in the coupler) and cause a buzzer to sound in the cab of the excavator for informing the operator of this condition.

From this condition, in which the retracted second latching mechanism 30 will hold both the blocking bar 58 and the first latching mechanism 28 in their open positions irrespective of the orientation of the coupler, the coupler can be reoriented such that its front jaw 18 can be engaged upon a first accessory pin 24 of an accessory 16. This is shown in FIG. 3. That step is step 2 of the connection procedure.

Then, as shown in FIG. 4, step 3 of the connection procedure is performed to complete the connection procedure. That third step involves rotating the coupler once again towards the crowd position for lifting the accessory 16 with the front jaw 18, whereupon the second accessory pin 25 of the accessory 16 will engage into the open second jaw 26 of the coupler 10. Then the actuator 54 (the hydraulic ram) can be extended again to drive the second latching mechanism 30 into its latching condition against the second accessory pin 25. That in turn will cause the flange or finger 66 to push the free end 44 of the arm 42 of the first latching mechanism 28 so as also to close the first latching mechanism relative to the first jaw 18. The coupling procedure is then complete, and upon returning the coupler to the normal use orientation, both the blocking bar and the arm 42 will fall under the influence of gravity into their rest, or blocking positions.

It should also be observed that the flange or finger 66 of the hook 30 will hold that first latching mechanism in its closed position, whereby the first accessory pin is for certain secured, even if the second accessory pin failed to engage into the second jaw. This is described again below with reference to FIG. 8.

Referring next to FIG. 5, the fully locked coupler is shown with its blocking bar 58 once again fallen into a blocking position behind the second latching mechanism 30, and with the first latching mechanism 28 in a fully dropped position, with its free end 44 below the shoulder 68. The accessory 16 is thus fully secured onto the coupler 10. For example, the possibility of accidentally opening the jaws of the coupler is prevented until the coupler assumes the crowd position. In that regard, the inadvertent opening of the first latching mechanism is restricted by the flange or finger 66 blocking its path, and the second latching mechanism 30 also being locked in a latching position against its respective accessory pin 25 by both the blocking bar 58 (as the primarily blocking mechanism since it blocks almost all rearward travel of the second latching mechanism 30 by view of its free end opposing the stepped face 62 at the rear of the latching mechanism 30) and the free end of the arm (in the event that the blocking bar fails to engage properly).

Referring next to the sequence of FIGS. 5 to 7, a decoupling procedure will now be described.

From the normal working condition of FIG. 5, an operator first moves the coupler and accessory 16 into a crowd position underneath the excavator arm, as shown in FIG. 6. This is to allow or cause the blocking bar to fall out of its blocking position, and to allow the arm to move into a position "above" the shoulder 68 of the second latching mechanism. These positions are all shown in FIG. 6.

Upon reaching this condition, the actuator or hydraulic ram 54 can be used to retract the second latching mechanism 30, and thus also to "lift" or open the first latching mechanism 28. Thus the front jaw and the rear jaw open roughly simultaneously.

The alarm in the cab may be just to notify the user of this crowd condition, but as discussed above for the coupling procedure, it is preferred that the system is instead arranged to sense that the jaws are both open (e.g. using the above mentioned sensors) and to then sound the alarm for that condition. This is to ensure that the operator closes the jaws (to turn off the buzzer).

In this condition, the actuator holds the second latching mechanism in its open position and thus also the first latching mechanism also in its open position. Therefore, the accessory 16 and coupler 10 can be rotated back out of the crowd position so as to place the bucket or accessory 16 gently on the ground. Then the coupler can simply be manipulated relative to that accessory (which being on the ground is deemed to be made safe) so as to decouple the coupler from the accessory and to move the coupler 10 away from the accessory 16. The dismounting procedure is thus completed, with the coupler already primed and ready for mounting onto the next accessory (since it is already in the condition of FIG. 3—all jaws open).

It will be appreciated from the above, therefore, that the present invention provides a coupler that offers very rapid and easy mounting and dismounting of accessories thereto, but without presenting the opportunity for accidental dismounting procedures to be carried out. This is because the crowd position (a position not usually used during the conventional use of an accessory) is needed to be used before a dismounting procedure can commence.

Then, referring to FIG. 8, an additional safety benefit of the present invention is shown. Here, a situation is illustrated where an operator error has occurred—the attachment procedure has been followed, but without correctly engaging the second accessory pin 25 in the second jaw 26 of the coupler 10. As such, the second latching mechanism 30 has been advanced into a "latching" position (e.g. to turn off the buzzer in the cab), but without capturing the second accessory pin 25. This type of error traditionally presented a dangerous situation since without a securement mechanism for the front jaw, the first accessory pin was free to fall out of the front jaw 18. However, with this invention, the first accessory pin 24 is securely locked into the front jaw 18 by the first latching mechanism 28, which is closed. Further, because of the finger 66 on the second latching mechanism, movement of that first latching member 28 is restricted such that it cannot move out of a latching position. As such, the pin 24 that is located in the first jaw 18 cannot be removed from the jaw 18 other than by recycling through the latching/dismounting procedure. Therefore, the operator is given an opportunity to spot and correct the incorrect mounting of the accessory on the coupler before further use of the accessory commences and without any risk of dropping the accessory off the coupler.

Referring next to FIG. 9, an alternative embodiment of the present invention is disclosed. This embodiment again has a blocking bar 158 and a separate front latch with an arm extending therefrom towards a rear latch 30. The actuator (hydraulic ram) for operating the rear latch 30, however, is only shown in phantom. This is for clarity since differences between the previous embodiment and this embodiment reside in the design of the blocking bar 158.

As can be seen, this blocking bar 158 has a hydraulic ram 162 provided in its bottom half—it is located within a chamber 160. It also features a coil spring (not shown) for keeping it biased towards a blocking position. The blocking bar and its hydraulic ram 162 is shown in greater detail in FIGS. 10 and 11, with FIG. 10 showing the whole blocking bar 158 and FIG. 11 being a partial cutaway view through the blocking bar 158, the cut being substantially along the blocking bar's longitudinal axis.

This alternative blocking bar is very similar to the blocking bar 58 of the previous embodiment. However, rather than being a solid blocking bar, it has a chamber 160 provided therein for accommodating a hydraulic cylinder 162. The hydraulic cylinder 162 is mounted within the chamber 160 along an axis substantially parallel to, but spaced from, the longitudinal axis of the blocking bar 158. However, as before it can be mounted differently, e.g. in a chamber pointing in a different direction. It has a free end 164 also lying on that axis of the cylinder 162. That cylinder 162, by being spaced away from the longitudinal axis of the blocking bar 158 is so spaced so as not to be coincident with the hinge axis of the blocking bar 158, as defined by the centre of the hinge pin 166, e.g. as shown in FIG. 9. As such, as the free end of the hydraulic cylinder can bear against a fixed element, such as a cut-out (not shown) on that hinge pin 166, whereby that cylinder 162 can cause the blocking bar to be lifted from its blocking position (similar to that shown in FIG. 9) to its non-blocking position (similar to that shown in FIGS. 13 and 14). The hydraulic cylinder 162 can therefore raise the blocking bar from a blocking position into a non-blocking position.

Hydraulic fluid can be supplied to the cylinder 162 through the port 170 that is located at the top of the blocking bar 158. A separate hydraulic fluid supply pipe can be connected to that port, controlled by a separate solenoid valve and a separate switch in the cab of the excavator (not shown), each being separate to similar arrangements provided for the primary actuator 54 of the coupler. The return pipes to the fluid reservoir (not shown), however, can follow a common route, or can be fluidly connected to follow a common return pipe. The two hydraulic power supplies to the two hydraulic actuators are described as being controlled independent to one another, however, for minimising the possibility of an accidental release.

For maintaining the blocking bar in a blocking position (i.e. when the hydraulic cylinder is not being powered), a spring is provided for the blocking bar. That spring can be inside the hydraulic cylinder for forcing a compression of the cylinder 162. Alternatively a ring spring can be provided within the bearing sleeve 168 of the blocking bar. Other arrangements are also possible for biasing the blocking bar towards a blocking position. With this arrangement a dual acting (i.e. bi-directional) hydraulic cylinder is not required for the blocking bar, although it can be provided if desired. The spring can then be provided as well, as a back-up safety measure.

As for the arm of the first latching mechanism, it is arranged to be engageable by the second latching mechanism such that the second latching mechanism can lift it to open the first latching mechanism. This can be achieved with a ramped surface on the second latching mechanism that faces towards the free end of the arm, or it can be achieved by the geometry of the facing surfaces at the point of contact therebetween. Such design details would be within the ambit of a skilled person. See, however, GB0816498.6 for details of a ramped rear surface for the second latching mechanism.

With this arrangement, there is no requirement for the coupler to be inverted in order to decouple an accessory from the coupler—both the arm and the blocking bar can be lifted into a non-blocking position remotely by the powered systems of the coupler—the blocking bar is lifted by its hydraulic actuator, whereas the arm 42 of the front latch can be lifted by the rear of the rear hook 30. This coupler can thus be used for changing accessories even in situations where inversion of the coupler is impossible or difficult, such as in tunnels or in other places where vertical headroom is limited—as explained previously, for achieving a crowd position, the elbow of the arm of the excavator needs to point upwards, whereby it is raised above the cab of the excavator.

It should also be observed that a remote lifting mechanism might also be provided for the arm of the first latching mechanism, such as a further hydraulic ram, controlled by a further circuit, so as to be further independent to the others.

An advantage of this biased blocking bar arrangement can also be observed from FIG. 12: in this embodiment an inversion of the coupler will not always cause the blocking bar to move to a non-latching position, whereby the spring for acting against the arm of the excavator can be removed. Further, an accidental positioning of the coupler into the crowd position will not put the coupler into an "accessory releasable" condition. That can only occur upon the powering of the blocking bar's counter biasing means—the hydraulic cylinder 162; see FIG. 13 where that hydraulic ram/cylinder/actuator has been extended for "lifting" the blocking bar into its non blocking position. Only then can the rear hook be powered into the open position, as shown in FIG. 14.

Referring finally to FIGS. 15 and 16, a further embodiment of coupler is shown. This embodiment has similarities to the original embodiment in that it has a pivoting rear latching hook 30, a blocking bar 58, a front latch 28 and two jaws 18, 26. Further, the blocking bar 58 is provided with a spring 60 for selectively biasing it into a closed, blocking position as shown in FIG. 15, upon engagement of that spring 60 against the arm of the excavator—which occurs when the coupler ex inverted into an extended condition, but not when the coupler is inverted into a crowd position. However, the designs of the first and second latching mechanisms 30, 28 are different.

The design of the second latching mechanism, the rear hook 30, is still provided with a finger 66 for engaging a free end of an arm 42 of the first latching mechanism 28. However, that finger 66 extends slightly further towards the front end of the coupler—i.e. further towards the first latching mechanism. This allows the arm 42 of the first latching mechanism to be fractionally shorter than before, whereby it will not foul against a knuckle 68 of the hook 30 in a blocking manner. This feature, however, is optional. Preferably, however, the free end facing surface of that hook 30 (but not the finger 66) can be designed still to engage against the free end 44 of the arm 42, but in a manner that causes the first latching mechanism to open into a non latching position. This can occur as the hook 30 is retracted by having the arm resiliently flexible such that it will flex upwardly, thus pivoting the first latching mechanism about its pivot pin 34. To allow that flexing, the arm 42 is preferably formed from a resilient, flexible material, such as spring steel or a series of plates of spring steel.

Where a series of plates of spring steel are provided, an end capping member, as shown, can be provided to hold those steel plates together at the free end 44. A similar end capping member can also be provided at the free end of the spring 60, as provided for the blocking bar, since it too can be a series of spring steel plates.

The finger 66 of the hook 30, however, is still arranged to control the range of motion of the arm 44 so as to not allow it readily to lift into a raised condition, even if the coupler is inverted, since it is desirable to keep both jaws closed unless a decision is taken to release the accessory. However, upon powering back the hook 30 into a non latching position, the first latching mechanism can be opened. First, however, the blocking bar needs to be released to allow that movement of the hook 30.

The first latching mechanism is also different to that shown in a previous embodiment. That is because, as described above, it is formed of a resilient, flexible material. This resilient, flexible material, e.g. the steel plates, is bolted onto a latching component of the first latching mechanism. As a result, those two components can be formed of different materials—the latching component of the first latching mechanism is preferably formed from a hard, stiff or tough material, such as hardened steel, so as to be able to resist attempts to remove an attachment pin 24 from within the first jaw 18 while the first latching mechanism is in a closed position.

Because the arm 42 is flexible, it is preferred that an additional stop arm 138 is provided for the latching component of the first latching mechanism. This stop arm 138 is preferably integral to the main body of the latching component such that that latching component can be of a one piece construction. The stop arm 138 provides a flange that is adapted to engage against the main structure of the jaw 18 so as to restrict the degree of rotation available for that latching component about its pivot pin. This therefore prevents an overloading of the resilient arm 42 in that that arm 42 does not serve as a stop for the rotation of the first latching mechanism.

Operation of this coupler is generally similar to that of the original embodiment of FIG. 1. In use, the coupler is inverted into the crowd position to allow gravity to cause the blocking bar 58 to drop into a non blocking position and such that the free end 44 of the arm 42 will fall to rest against the finger 66 of the rear hook 30. Then, the rear hook 30 is powered backwards by the actuator 54 so as to open the rear jaw 26. This in turn allows the arm 42 of the first latching mechanism also to rotate about the first latching mechanism's pivot axis 34 and thus the first jaw 18 also opens. Once open, the rear jaw 30 is remained in its open position whereby its back can hold the arm in its non-latching position and the coupler can then be coupled onto an accessory by locating a first attachment pin 24 thereof in the first jaw 18 and then a second attachment pin 25 thereof in the second jaw 26. Then, the rear hook 30 can be powered back into a latching position so as to allow the first latching mechanism to close the first jaw 18. The accessory is thus coupled onto the coupler. Further, since in locating the second attachment pin 25 into the rear jaw 26, the coupler will have been reinverted into a normal upright configuration, the blocking bar 58 will fall once again into position behind the relevant part of the rear hook 30, thus restoring its blocking condition (at least until the coupler is again returned into a crowd position (for releasing the blocked bar—the spring 60 provides the necessary biasing force for the blocking bar).

It is also to be appreciated that a powered blocking bar, as per the embodiment of FIG. 9, can be provided. The rear of the hook 30 would then want to be shaped to lift, or flex the arm of the first latching mechanism, as already described above in relation to other possible arrangements. Such a configuration would preferably allow an accessory to be uncoupled from the coupler even while the coupler is in a horizontal (non-inverted) orientation, whereby the coupler can more readily be used in situations where inversion is made difficult (e.g. by height restrictions, or by the shape of the accessory—i.e. where it is too long to be moved into the crowd position). Such situations include large tools, rail and tunnel environments, and situations where overhead power lines are located.

To dismount an accessory from the coupler of FIG. 15, again the coupler is inverted into the crowd position, and the rear hook 30 is powered into an open position. This again opens the front jaw whereupon the accessory can then be decoupled therefrom.

It will of course be apparent to a skilled person that elements of one embodiment can be adapted for use with the other embodiments. For example, the sprung arm 42 of the final embodiment could be used to replace the arms in the other embodiments. Further, the powered blocking bar can be used in other embodiments, again as described above.

The present invention has therefore been described above purely by way of example. Modifications in detail may be made to the invention within the scope of the claims appended hereto.

The invention claimed is:

1. A coupler for coupling an accessory to an excavator arm of an excavator, the coupler comprising first and second jaws associated with first and second latching mechanisms, respectively, for latching first and second attachment pins of the accessory within the respective first and second jaws, the first latching mechanism comprising a jaw closing member that is pivotally mounted relative to the first jaw, that jaw closing member at least partially closing the first jaw when positioned in a jaw closing position, and that jaw closing member having extending therefrom, within the framework of the coupler, an arm, the arm being selectively engageable by the second latching mechanism and resiliently flexible along at least a part of its length such that when the first latching mechanism is latching the first attachment pin of the accessory in the first jaw, the arm will resiliently flex, rather than plastically flex when a force is applied at or near its free end by the second latching mechanism being opened.

2. The coupler of claim 1, wherein the arm is formed from spring steel.

3. The coupler of claim 2, wherein the arm is formed from a series of spring steel plates.

4. The coupler of claim 1, wherein the arm is bolted onto the jaw closing member.

5. The coupler of claim 1, wherein the first jaw is a front jaw of the coupler.

6. The coupler of claim 1, wherein the second latching mechanism provides for securing against a second pin of the accessory.

7. The coupler of claim 6, wherein that second latching mechanism is a rear hook of the coupler.

8. The coupler of claim 6, wherein the second latching mechanism is pivotally mounted relative to a frame of the coupler.

9. The coupler of claim 6, wherein the arm extends between the first latching mechanism and the second latching mechanism so as to be engageable at or near its free end by the second latching mechanism.

10. The coupler of claim 9, wherein the second latching mechanism has a groove, flange or finger for selectively engaging the arm at or near the arm's free end.

11. The coupler of claim 6, further comprising a blocking bar, wherein the blocking bar has an integrated spring or piston, or both, the integrated spring or piston being mounted within a chamber within the blocking bar.

12. The coupler of claim 11, wherein the blocking bar has a pivot axis and a central axis that extends through the blocking bar's pivot axis, and the chamber extends substantially parallel to, but spaced from, the central axis of the blocking bar.

13. The coupler of claim 6, wherein movements of the second latching mechanism are adapted to operate the first latching mechanism both from its latching position into its non-latching position and from its non-latching position into its latching position.

14. The coupler of claim 6, wherein the second latching mechanism is associated with a gravity operated blocking bar.

15. The coupler of claim 6, adapted such that the second latching mechanism is powered for movement into a non-latching position, whereupon the free end of the arm of the first latching mechanism, upon engagement by the second latching mechanism, is moved by the movement of the second latching mechanism, so as to move a latching face of the first latching mechanism out of the mouth of the first jaw and into a non-latching position.

16. The coupler of claim 6, wherein a flange or finger is provided at the rear of the second latching mechanism, that flange or finger being arranged so as to be engageable with the free end of the arm of the first latching mechanism.

17. The coupler of claim 1, further comprising a blocking bar, wherein the blocking bar is provided with a biasing means to bias it towards a blocking position and a counter-biasing means for selectively moving the blocking bar into a non blocking position.

18. A coupler comprising first and second jaws or accessory engagement areas for receiving first and second accessory pins or accessory attachment members of an accessory, wherein:

a first latching mechanism is associated with the first jaw or accessory engagement area, the first latching member having a resiliently flexible arm operatively connected to and extending away from a latching member thereof;

a second latching mechanism is associated with the second jaw or accessory engagement area;

the first and second latching mechanisms are adapted to latch the first and second accessory pins or accessory attachment members of an accessory in or on the first jaw or accessory engagement area and the second jaw or accessory engagement area, respectively;

the second latching mechanism is powered for movement between a latching position and a non-latching position; and the first latching mechanism is operatively connected to, or connectable with, the second latching mechanism by the flexible arm to allow operation of the second latching mechanism selectively to operate the first latching mechanism between its own latching and non-latching positions by means of a groove or flange or finger provided on the second latching mechanism.

19. A coupler for attaching to an excavator arm of an excavator the coupler comprising:

a first jaw having an opening pointing generally forwards with respect to the coupler for receiving a first accessory attachment member of an accessory; and a second accessory engagement area facing generally downwards with respect to the coupler for receiving a second accessory attachment member of the accessory;

wherein:

a first latching mechanism is associated with the first jaw, the first latching member having a resiliently flexible arm operatively connected to and extending away from a latching member thereof;

a second latching mechanism is associated with the second accessory engagement area;

the first and second latching mechanisms are adapted to latch first and second accessory attachment members of an accessory in or on the first jaw and the second accessory engagement area, respectively;

the second latching mechanism is powered for movement between a latching position and a non-latching position and the first latching mechanism is operatively connected to, or connectable with, the second latching mechanism by the flexible arm to allow operation of the second latching mechanism to selectively operate the first latching mechanism between its own latching and non-latching positions; and the second latching mechanism is provided with a groove or flange or finger for defining a pair of surfaces or a space on or in which a free end of the flexible arm of the first latching mechanism can rest or reside either or both during a coupling procedure or a decoupling procedure of the coupler so as to allow the movement of the second latching mechanism to operate the first latching mechanism between its latching position and its non-latching position.

* * * * *